US005235893A

United States Patent [19]

Malta

[11] Patent Number: 5,235,893

[45] Date of Patent: Aug. 17, 1993

[54] TUNED MUSICAL HANDBELL MADE OF ALUMINUM

[75] Inventor: Jacob H. Malta, New Britain, Pa.

[73] Assignee: Malmark, Inc., Plumsteadville, Pa.

[21] Appl. No.: 795,042

[22] Filed: Nov. 20, 1991

[51] Int. Cl.[5] ..... G10D 13/08; G10K 1/071

[52] U.S. Cl. ..... 84/406; 116/171; 84/452 R

[58] Field of Search ..... 84/406, 407, 103, 452 R; 116/171

[56] References Cited

U.S. PATENT DOCUMENTS

| | | | |
|---|---|---|---|
| 236,652 | 1/1881 | Torrey | 116/171 |
| 2,695,589 | 12/1954 | Hubbell | 84/406 |
| 2,749,637 | 6/1956 | Bradshaw | 116/171 |
| 2,787,929 | 4/1957 | Musser | 116/171 |
| 2,818,829 | 1/1958 | Hendrick | 116/171 |
| 4,186,682 | 2/1980 | Longsdorf et al. | 116/171 |
| 4,566,400 | 1/1986 | Keenan et al. | 84/406 |

FOREIGN PATENT DOCUMENTS

| | | | |
|---|---|---|---|
| 11939 | of 1894 | United Kingdom | 116/171 |
| 670125 | 4/1952 | United Kingdom | 116/171 |

*Primary Examiner*—Michael L. Gellner
*Assistant Examiner*—Cassandra Spyrou
*Attorney, Agent, or Firm*—Gregory J. Gore

[57] ABSTRACT

A tuned musical handbell has been devised which has a surprisingly excellent musical tone quality. A bell casting made from aluminum is sized and tuned by metalworking processes to frequencies below 196 Hertz. Aluminum alloys, such as numbers 319, 356, and Precedent 71 are suitable. The aluminum handbells are produced as individual elements of a complete set which include the use of aluminum for frequencies below 196 Hertz, and bronze for frequencies above 196 Hertz.

6 Claims, 1 Drawing Sheet

TUNED MUSICAL HANDBELL MADE OF ALUMINUM

FIELD OF THE INVENTION

This invention relates to percussion-type tonal musical instruments and, more specifically, it relates to tuned musical handbells.

BACKGROUND OF THE INVENTION AND PRIOR ART

Historically, bells have been cast of bronze alloy with varying percentages of copper and tin according to the frequency of the bell. The amount of tin in the alloy is approximately 20%, plus 3% for bells of high frequency, and minus 3% for low-frequency bells. A bronze casting alloy has always been the material known to give the most desirable combination of tonal clarity and sustain.

The bell may be used in its natural state after casting or, as in the case of handbells, may be further finished by "tuning". In tuning, the cast bell is shaped by the removal of material, and further may be polished in order to produce an exact fundamental frequency representing a particular pitch of the musical scale. The fundamental frequency of the bell may be further enhanced by tuning techniques which produce secondary harmonic frequencies. In what is commonly referred to as an English-tuned handbell, both the fundamental frequency and a harmonic representing twelve increments of the musical scale are present. The practice of bell tuning is as much an art as it is a science.

The art of handbells has particular requirements in the bell arts. It is always desirable to have the widest range of frequencies available for playing by a handbell choir, however, the lowest frequency practical is progressively weakened and diminished by the necessity to keep the diameters and weights of the individual handbells within limits manageable to the handbell ringer. In the handbell arts, each bell representing a different musical note is referred to by a notation of its letter note on the music scale followed by its octave number, such as C3, B4, A2, etc. It has been known that by keeping handbell diameters within 20 inches and weights within 20 pounds, that below the G1 note, the volume of the fundamental tone becomes difficult to hear. While the bronze alloy material mentioned is particularly suitable and exhibits a pleasing tone in the higher frequency ranges of handbells, its tonal qualities are lacking in the lower frequencies.

Experiments have been conducted with aluminum for use in tuned bells, but it was found lacking because it did not produce mid-to-high frequencies well, due to the inherent damping characteristics of the metal. Aluminum has never been successfully tried as a bell material in a handbell of musical quality. The use of aluminum as a bell material, therefore, has been limited to untuned cast bells, such as farm bells and patio bells where tone quality is not important.

SUMMARY OF THE INVENTION

The applicant has discovered various alloys of aluminum to be surprisingly superior to the well-known bronze alloys in the particular application of tuned musical handbells of low frequency. In frequencies from the note C3 down to G1, there have been surprising results. It is not known that anyone before has attempted to tune an aluminum bell at a frequency below G3. Tonal quality and sustain have been realized with aluminum alloys, numbers 319, 356, and Precedent 71, a heat-treated alloy. All of these alloys have been used with surprising success.

The aluminum bells are cast in much the same way as bronze, with molds made with a particular dimension and shape to optimally produce the fundamental note of the bell desired. The bells are then hand-tuned by polishing and metal working processes in order to produce the most faithful reproduction of the fundamental note, with the greatest clarity, and the longest tonal sustain. The aluminum bells are produced as individual elements of a complete set of handbells which include the use of both aluminum and bronze casting materials. This use of different materials for different bells within a set of handbells is heretofore unknown, all handbell sets previously being uniformly produced from a single material.

It is, therefore, an object of the present invention to produce a complete set of handbells of expanded frequency range utilizing aluminum as the casting material for bells in the lower octaves, while utilizing bronze as the casting material for bells in the higher octave.

DESCRIPTION OF THE PREFERRED EMBODIMENT

Figure 1:
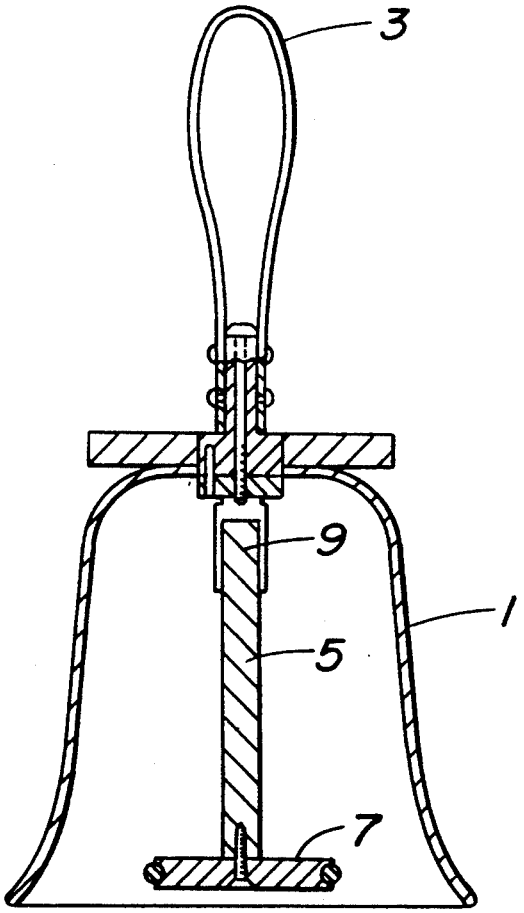
FIG. 1 is a front sectional view of the present handbell invention.

As shown in the drawing, each handbell includes a bell portion 1 which begins as a metal casting. The casting is then machined to a precise size and shape which optimally produces the bell's fundamental note. Each handbell has a handle 3 and a striking element 7 within the bell affixed to shaft 5 which pivots at joint 9 to sound the bell. A full range of handbells for playing by a handbell choir produces notes having fundamental frequencies between C8 and G1. Bells of the type shown in the drawing are used having varying dimensions to most faithfully produce their musical note.

The bells of frequencies of G3 (196 Hertz) and above are cast from bronze alloy and are hand-tuned by polishing and other metal-working processes to achieve the highest musical quality of their respective fundamental tonal frequencies. Notes below G3 (196 Hertz) include bells cast from aluminum which are similarly hand-tuned to produce the highest tonal quality of their fundamental frequency. The bells of different alloys as described above are played together with the possibility of chords being played by combinations of bells made individually from either aluminum or bronze. It is heretofore unknown to produce musical quality notes and chords in this way. The result is a musically pleasing sound with a full range of notes from low to high frequencies now made available to handbell ringers.

It should be understood that the above description discloses specific embodiments of the present invention and are for purposes of illustration only. There may be other modifications and changes obvious to those of ordinary skill in the art which fall within the scope of the present invention which should be limited only by the following claims and their equivalents.

What is claimed is:

1. A musical handbell instrument, comprising:

a handle;

a bell affixed to said handle, including a striking member within the bell; and said bell cast of aluminum and shaped by metal-working processes to have dimensions and a contour for optimally producing a pure fundamental tone and a twelfth note harmonic of the musical scale.

2. A handbell of claim 1 having a musical pitch below G3 (196 Hertz) in the third octave.

3. A handbell of claim 1 which has a diameter of less than 20 inches and weighs less than 20 pounds.

4. A tuned set of musical handbells, comprising:

a plurality of bells, each bell representing a discrete note within the musical scale and having a range from the first octave up through C8 in the eighth octave, the handbells of said set representing the musical notes below G3 in the third octave, said handbells comprising a handle, a bell affixed to said handle, including a striking member within the bell, said bell cast of aluminum and shaped by metal-working processes to have dimensions and a contour for optimally producing a pure fundamental tone and a twelfth note harmonic of the musical scale, and the handbells representing musical notes above F#3 in the third octave comprising tuned handbells which are cast of a bronze alloy.

5. The handbell of claim 1, further described in that said aluminum is an aluminum alloy.

6. The handbell of claim 5, wherein said aluminum alloy is a material selected from the group consisting of; #319, #356, and Precedent 71.

* * * * *